US009828745B2

(12) United States Patent
Ueda et al.

(10) Patent No.: US 9,828,745 B2
(45) Date of Patent: Nov. 28, 2017

(54) CONSTRUCTION MACHINE

(71) Applicant: KOBELCO CONSTRUCTION MACHINERY CO., LTD., Hiroshima-shi (JP)

(72) Inventors: Koji Ueda, Hiroshima (JP); Takaaki Izuka, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 396 days.

(21) Appl. No.: 14/718,452

(22) Filed: May 21, 2015

(65) Prior Publication Data

US 2015/0354605 A1 Dec. 10, 2015

(30) Foreign Application Priority Data

Jun. 9, 2014 (JP) ..... 2014-118301

(51) Int. Cl.
*E02F 9/22* (2006.01)

(52) U.S. Cl.
CPC ..... *E02F 9/2203* (2013.01); *E02F 9/226* (2013.01); *E02F 9/2217* (2013.01); (Continued)

(58) Field of Classification Search
CPC ..... F15B 2211/611; F15B 2211/3116; F15B 2211/62; E02F 9/2203; E02F 9/2217; (Continued)

(56) References Cited

U.S. PATENT DOCUMENTS 7,096,772 B2 * 8/2006 Sporer ..... E02F 9/2221 60/329
7,287,374 B2 * 10/2007 Vigholm ..... G05D 24/02 60/329

(Continued)

FOREIGN PATENT DOCUMENTS

EP 1 985 869 A1 10/2008
EP 2 770 219 A1 8/2014

(Continued)

OTHER PUBLICATIONS

Extended European Search Report dated Dec. 10, 2015 in Patent Application No. 15169537.6.

*Primary Examiner* — Thomas E Lazo
(74) *Attorney, Agent, or Firm* — Oblon, McClelland, Maier & Neustadt, L.L.P.

(57) ABSTRACT

A construction machine is provided which is capable of warming up without an additional hydraulic device. A hydraulic excavator includes a cooling oil line connected to an arm control valve for leading hydraulic oil discharged from the arm control valve to a tank through an oil cooler when the arm control valve is shifted to an extension position, and a non-cooling oil line connected to the arm control valve for leading hydraulic fluid discharged from the arm control valve to the tank running away from the oil cooler when the arm control valve is shifted to a neutral position. The arm control valve includes a guide passage provided at the neutral position for leading hydraulic fluid discharged from a hydraulic pump to the non-cooling oil line.

5 Claims, 5 Drawing Sheets

(52) U.S. Cl.
CPC ..... *E02F 9/2282* (2013.01); *E02F 9/2285* (2013.01); *E02F 9/2296* (2013.01); *F15B 2211/3116* (2013.01); *F15B 2211/611* (2013.01); *F15B 2211/62* (2013.01)

(58) Field of Classification Search
CPC ..... E02F 9/226; E02F 9/2282; E02F 9/2285; E02F 9/2296
USPC ..... 60/456
See application file for complete search history.

(56) References Cited

U.S. PATENT DOCUMENTS

| | | | | |
|---|---|---|---|---|
| 8,051,649 | B2 * | 11/2011 | Yoshimoto | E02F 9/226 60/329 |
| 9,103,096 | B2 * | 8/2015 | Kondo | B66F 9/22 |
| 2009/0217656 | A1 | 9/2009 | Yoshimoto et al. | |
| 2012/0144817 | A1 | 6/2012 | Kondo | |

FOREIGN PATENT DOCUMENTS

| | | | |
|---|---|---|---|
| JP | 2002-130216 | A | 5/2002 |
| JP | 2005-155698 | | 6/2005 |

* cited by examiner

CONSTRUCTION MACHINE

TECHNICAL FIELD

The present invention relates to a construction machine including a hydraulic actuator.

BACKGROUND ART

Hydraulic fluid which circulates in a hydraulic circuit of a construction machine is likely to have heat when a pressure loss or the like occurs due to flow resistance at a hydraulic device. For this reason, conventionally, the construction machine is provided with an oil cooler for cooling the hydraulic fluid.

On the other hand, when a construction machine is located under a low outside temperature condition such as in a cold district, the temperature of hydraulic fluid is liable to drop when the construction machine is in a stopped state, so that the cold hydraulic fluid is liable to negatively affect the operation of a hydraulic device when the construction machine is activated.

Here, it is considered to heat the hydraulic fluid at the time of activation of the construction machine. However, a long period of time would be required to heat the hydraulic fluid in the case that the hydraulic fluid is circulated in a hydraulic circuit having an oil cooler.

In view of this problem, when a construction machine is activated, hydraulic fluid is caused to circulate in a hydraulic circuit without passing through an oil cooler, whereby the hydraulic fluid is heated to warm up the construction machine (for example, Japanese Patent Application No. 2005-155698, which will be hereinafter referred to as Patent Literature 1).

A hydraulic circuit disclosed in Patent Literature 1 includes a hydraulic pump, a hydraulic actuator to be operated by hydraulic fluid discharged from the hydraulic pump, a control valve for controlling the operation of the hydraulic actuator, and a switch valve for switching an oil line designated as a destination of supply of hydraulic fluid, between a cooling oil line including an oil cooler and a non-cooling oil line running away from the oil cooler.

The control valve is shifted between a permitting position to permit supply of hydraulic fluid to the hydraulic actuator and a restricting position (neutral position) to restrict the supply of hydraulic fluid to the hydraulic actuator. Hydraulic fluid discharged from the hydraulic pump is led to the switch valve via the control valve.

The switch valve is shifted to a position to lead hydraulic fluid to a cooling oil line when the control valve is shifted to the permitting position, and shifted to another position to lead hydraulic fluid to the non-cooling oil line when the control valve is shifted to the restricting position.

This allows hydraulic fluid to circulate in the hydraulic circuit without passing through the oil cooler to thereby warm up the construction machine when the control valve is at the restricting position (at the time of activation of the construction machine when the hydraulic actuator is not operating).

However, the hydraulic circuit disclosed in Patent Literature 1 includes the switch valve for switching the oil line designated as a destination of supply of hydraulic fluid, in addition to the control valve for controlling the operation of the hydraulic actuator, which results in a complicated configuration of and an increase in the cost for, the hydraulic circuit.

SUMMARY OF INVENTION

The present invention has an object of providing a construction machine capable of warming up without an additional hydraulic device.

In order to achieve this object, the present invention provides a construction machine, comprising: a hydraulic pump for discharging hydraulic fluid; a hydraulic actuator to be operated by hydraulic fluid discharged from the hydraulic pump; a tank for receiving hydraulic fluid discharged from the hydraulic actuator; a control valve shiftable between a permitting position to permit supply of hydraulic fluid from the hydraulic pump to the hydraulic actuator and discharge of hydraulic fluid from the hydraulic actuator to the tank and a restricting position to restrict the supply and the discharge of hydraulic fluid; a cooling oil line including an oil cooler for cooling hydraulic fluid, and being connected to the control valve for leading hydraulic oil discharged from the control valve to the tank through the oil cooler when the control valve is shifted to the permitting position; and a non-cooling oil line connected to the control valve for leading hydraulic oil discharged from the control valve to the tank running away from the oil cooler when the control valve is shifted to the restricting position, wherein the control valve includes a guide passage provided at the restricting position for allowing hydraulic oil discharged from the hydraulic pump to flow to the non-cooling oil line.

According to the present invention, it is possible to warm up the construction machine without including an additional hydraulic device.

These and other objects, features and advantages of the present invention will become more apparent upon reading the following detailed description along with the accompanying drawings.

DESCRIPTION OF EMBODIMENTS

Hereinafter, embodiments of the present invention will be described with reference to the accompanying drawings. It should be noted that the following embodiments illustrate some examples of the invention, and not delimit the protection scope of the invention.

First Embodiment (FIGS. 1 to 4)

Figure 1:
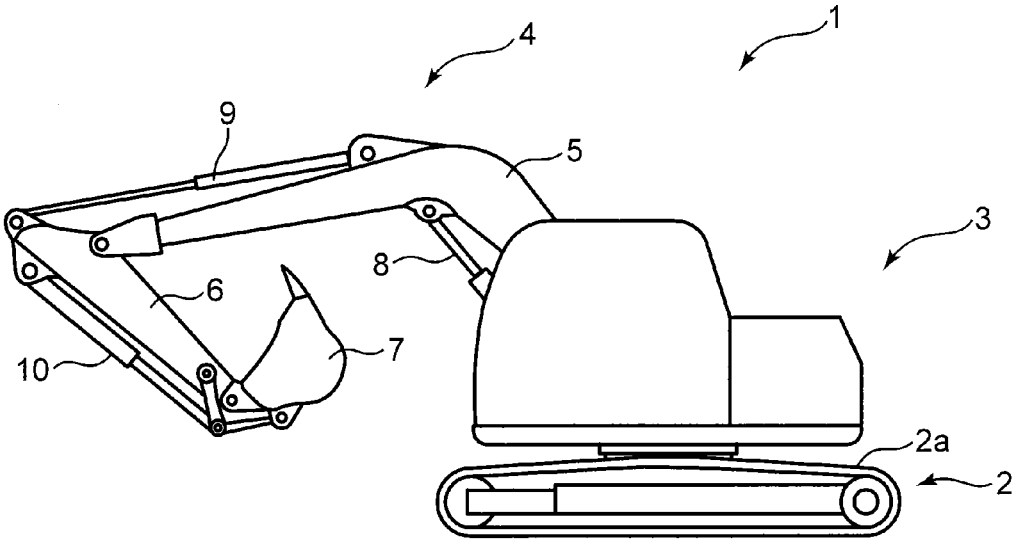
FIG. 1 is a side view showing an overall configuration of a hydraulic excavator according to a first embodiment of the present invention.

With reference to FIG. 1, a hydraulic excavator 1, which exemplifies a construction machine according to an embodiment of the present disclosure, includes a lower propelling body 2 having a pair of crawlers 2*a*, an upper slewing body 3 pivotally mounted on the lower propelling body 2, and a working machine 4 actionably mounted on the upper slewing body 3.

The working machine 4 includes a boom 5 mounted on the upper slewing body 3 in such a manner as to be raised and lowered (to be moved upward and downward), an arm 6 pivotally mounted to a distal end of the boom 5 so as to be moveable forward and backward, and a bucket 7 pivotally mounted to a distal end of the arm 6.

Further, the working machine 4 includes a boom cylinder 8 (which exemplifies "another hydraulic actuator") for driving the boom 5 to move upward and downward with respect to the upper slewing body 3, an arm cylinder 9 (which exemplifies "a hydraulic actuator") for driving the arm 6 to pivot with respect to the boom 5, and a bucket cylinder 10 for driving the bucket 7 to pivot with respect to the arm 6. The arm cylinder 9 is provided between the boom 5 and the arm 6 in such a way as to contract to move the arm 6 forward and extend to move the arm 6 backward.

Figure 2:
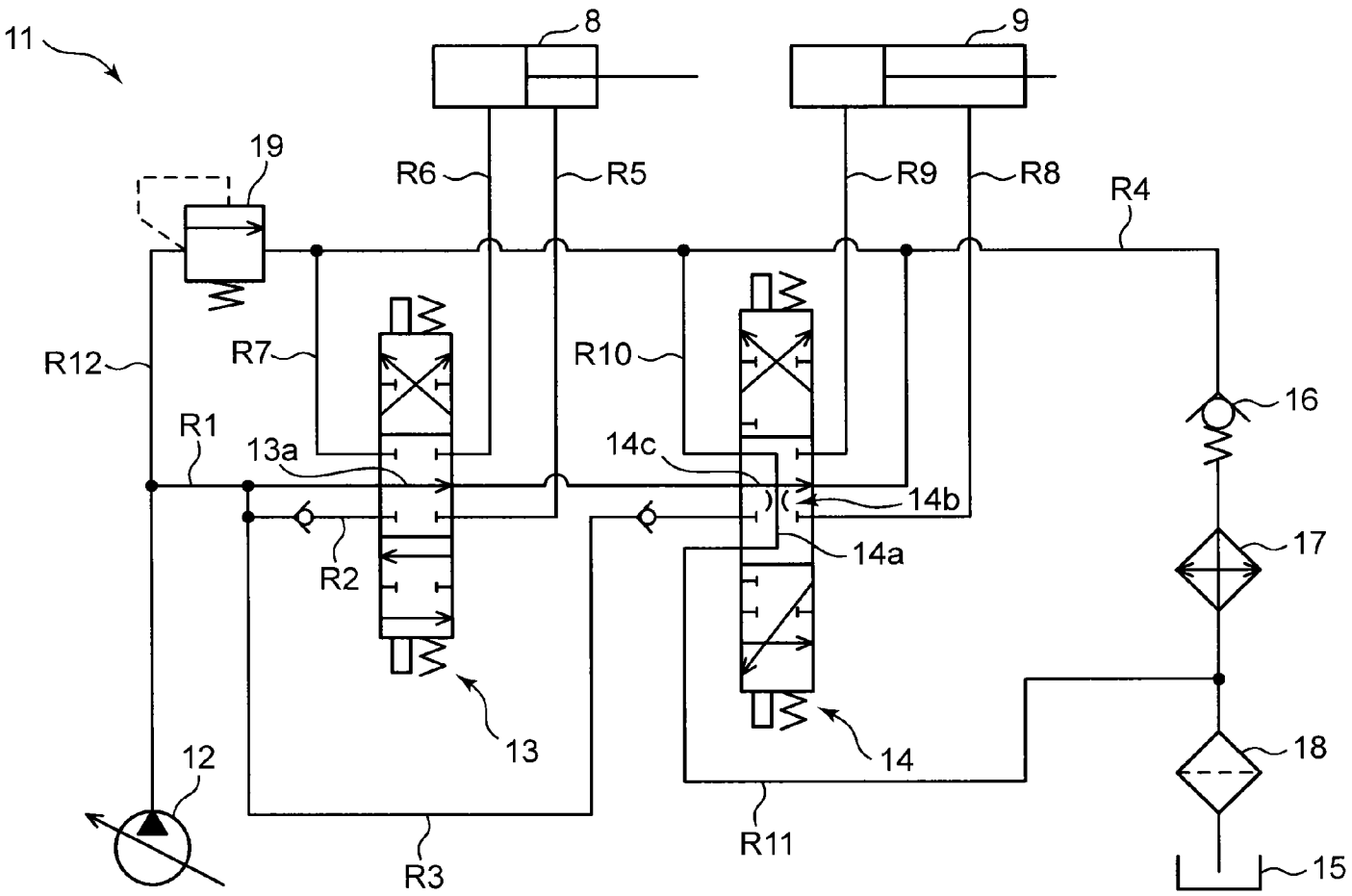
FIG. 2 is a circuit diagram showing a hydraulic circuit provided in the hydraulic excavator shown in FIG. 1.

As shown in FIG. 2, the upper slewing body 3 includes a hydraulic circuit 11 containing the cylinders 8 to 10 (only the cylinders 8 and 9 being shown in FIG. 2).

The hydraulic circuit 11 includes a hydraulic pump 12 for discharging hydraulic fluid, a boom control valve 13 for controlling the operation of the boom cylinder 8, an arm control valve 14 for controlling the operation of the arm cylinder 9, and a tank 15 for receiving hydraulic fluid discharged from the boom cylinder 8 and the arm cylinder 9.

The hydraulic pump 12 is connected to center bypass passages 13*a* and 14*c* (bypass passage), which are provided in the boom control valve 13 and the arm control valve 14, respectively, via a tandem oil line R1 and to the tank 15 via a cooling oil line R4.

The cooling oil line R4 leads hydraulic fluid to the tank 15 while cooling the hydraulic fluid. Specifically, the cooling oil line R4 includes a back pressure valve 16, an oil cooler 17, and a filter 18 provided in this order from upstream to downstream. The back pressure valve 16 generates a back pressure on the secondary side of each of the control valves 13 and 14. The oil cooler 17 cools hydraulic fluid. The filter 18 removes foreign matter contained in hydraulic fluid.

The hydraulic pump 12 is connected to the cooling oil line R4 via a relief oil line R12 branching from the tandem oil line R1, the relief oil line R12 running away from the control valves 13 and 14. The relief oil line R12 includes a relief valve 19 which is opened when a discharge pressure of the hydraulic pump 12 exceeds a predetermined relief pressure. In other words, the cooling oil line R4 is connected with the relief valve 19 in such a way as to receive hydraulic fluid discharged from the relief valve 19 when the relief valve is opened. This allows the relief valve 19 to open when the pressure on the primary side of each of the control valves 13 and 14 exceeds the relief pressure due to an increase in the load on the cylinders 8 and 9, to thereby allow hydraulic fluid discharged from the hydraulic pump 12 to flow to the cooling oil line R4 without passing through the control valves 13 and 14.

The boom control valve 13 is connected to the hydraulic pump 12 in parallel with the arm control valve 14 via a parallel oil line R2. Similarly, the arm control valve 14 is connected to the hydraulic pump 12 in parallel with the boom control valve 13 via a parallel oil line R3. This allows hydraulic fluid discharged from the hydraulic pump 12 to flow to both of the control valves 13 and 14 through the parallel oil lines R2 and R3.

The boom control valve 13 controls the operation of the boom cylinder 8 by regulating supply and discharge of hydraulic fluid to and from the boom cylinder 8. Specifically, the boom control valve 13 is shifted between a neutral position (the central position in the drawings) to stop the operation of the boom 5, a boom raising position (the upper position in the drawings) to raise the boom 5 (i.e. extend the boom cylinder 8), and a boom lowering position (the lower position in the drawings) to lower the boom 5 (i.e. contract the boom cylinder 8). The boom control valve 13 is configured as a pilot valve or an electromagnetic valve, the boom control valve 13 being usually biased to the neutral position and being shifted to the boom raising position or to the boom lowering position upon reception of a command from an unillustrated operation lever.

Further, the boom control valve 13 is connected to a rod-side chamber of the boom cylinder 8 via a rod-side oil line R5 and to a bottom-side chamber of the boom cylinder 8 via a bottom-side oil line R6.

Further, the boom control valve 13 is connected with a return oil line R7 which is connected to the bottom-side oil line R6 or the rod-side oil line R5 serving as a return-side line when the boom control valve 13 is shifted to the boom raising position or to the boom lowering position. The return oil line R7 is connected to the cooling oil line R4 upstream of the back pressure valve 16.

The arm control valve 14 is shifted between a neutral position (restricting position: the central position in the drawings) to stop the operation of the arm 6, an extension position (permitting position: the upper position in the drawings) to move the arm 6 backward (i.e. extend the arm cylinder 9), and a contraction position (the lower position in the drawings) to move the arm 6 forward (i.e. contract the arm cylinder 9). The arm control valve 14 in the extension position or the contraction position allows hydraulic fluid to flow from the hydraulic pump 12 to the arm cylinder 9 and from the arm cylinder 9 to the tank 15. On the other hand, the arm control valve 14 in the neutral position prevents hydraulic fluid from flowing from the hydraulic pump 12 to the arm cylinder 9 and from the arm cylinder 9 to the tank 15.

Specifically, the arm control valve 14 is connected to a rod-side chamber of the arm cylinder 9 via a rod-side oil line 8 and to a bottom-side chamber of the arm cylinder 9 via a bottom-side oil line R9.

Further, the arm control valve 14 is connected to the cooling oil line R4 via a return oil line R10 for allowing hydraulic fluid to flow from the arm control valve 14 to the tank 15 through the oil cooler 17 when the arm control valve 14 is shifted to the extension position.

On the other hand, the arm control valve 14 is connected to a non-cooling oil line R11 for allowing hydraulic fluid to flow from the arm control valve 14 to the tank 15 without passing through the back pressure valve 16 and the oil cooler 17 when the arm control valve 14 is shifted to the contraction position. The non-cooling oil line R11 is connected to the cooling oil line R4 downstream of the oil cooler 17.

Further, the arm control valve 14 includes a guide passage 14*a* provided at the neutral position (restricting position) for leading hydraulic fluid discharged from the hydraulic pump 12 to the non-cooling oil line R11. The guide passage 14*a* connects the cooling oil line R4 and the non-cooling oil line R11 via the return oil line R10 when the arm control valve 14 is at the neutral position. This allows hydraulic fluid to circulate in the hydraulic circuit 11 without passing through the oil cooler 17 to be thereby heated when the arm control valve 14 is at the neutral position.

Specifically, when the boom control valve 13 and the arm control valve 14 are at their respective neutral positions as shown in FIG. 2, the hydraulic pump 12 is connected to the cooling oil line R4 upstream of the oil cooler 17 via the center bypass passages 13*a* and 14*c* provided at the neutral positions of the control valves 13 and 14, respectively. This allows hydraulic fluid discharged from the hydraulic pump 12 to flow to the cooling oil line R4 through the bypass passages 13*a* and 14*c*. Here, the flow resistance of hydraulic fluid in the cooling oil line R4 is greater than that in the non-cooling oil line R11 due to the presence of the oil cooler 17. Therefore, the connection of the cooling oil line R4 and the non-cooling oil line R11 via the guide passage 14*a* allows hydraulic fluid discharged from the hydraulic pump 12 to flow to the tank 15 through the cooling oil line R4, the guide passage 14*a*, and the non-cooling oil line R11 to be again discharged from the tank 15 by the hydraulic pump 12. In this manner, the hydraulic fluid which circulates in the hydraulic circuit 11 without passing through the oil cooler 17 will be heated by heat generated with occurrences of pressure losses in the passages of circulation.

However, in this case, hydraulic fluid is heated mainly by the heat generated with occurrences of pressure losses in the flow passage. Therefore, a relatively long period of time would be required to sufficiently heat the hydraulic fluid.

Figure 3:
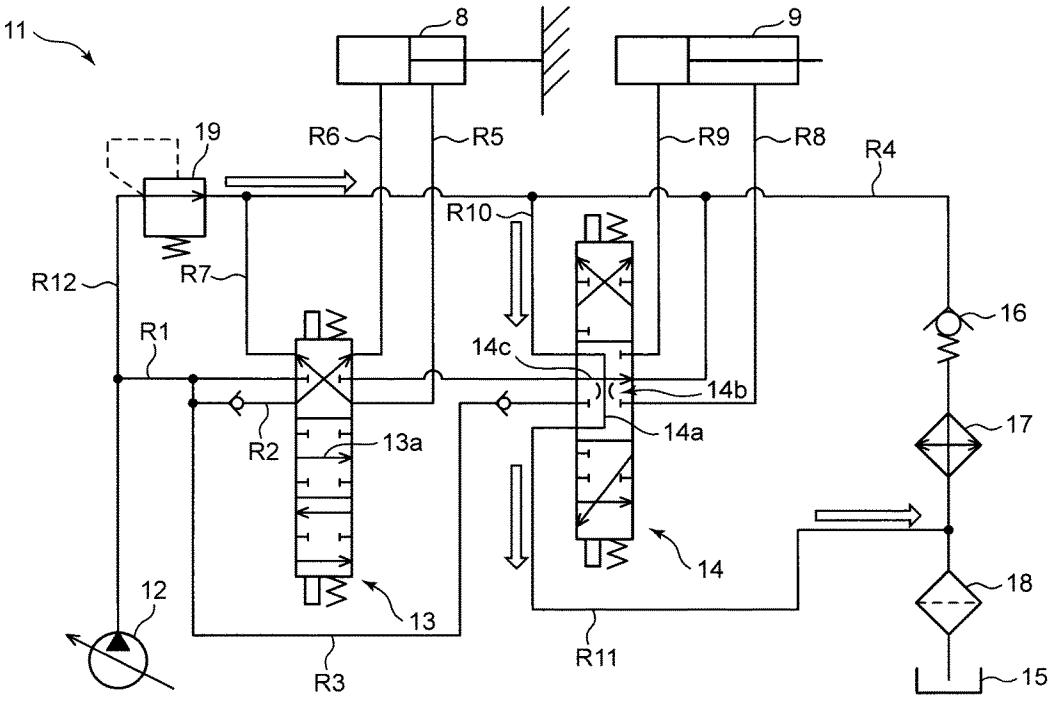
FIG. 3 is a circuit diagram illustrating an operation of the hydraulic circuit shown in FIG. 2, in which a relief valve is opened owing to an operation of a boom cylinder.

Accordingly, it is considered to heat hydraulic fluid by making use of heat that is generated when the hydraulic fluid passes through the relief valve 19. For example, when the boom control valve 13 is at the extension position and the boom cylinder 8 is prevented from extending (for example, when the boom cylinder 8 is at its stroke end position) as shown in FIG. 3, the relief valve 19 is open. In this state, hydraulic fluid discharged from the hydraulic pump 12 is led to the cooling oil line R4 through the relief valve 19. Here, if the arm control valve 14 is at the neutral position, hydraulic fluid in the cooling oil line R4 that has been heated in the course of flowing through the relief valve 19 is led from the cooling oil line R4 to the tank 15 through the guide passage 14*a* and the non-cooling oil line R11 as shown by the arrows in FIG. 3, whereby hydraulic fluid can be heated in a relatively short time.

In particular, in the case of use of the heat generated by hydraulic fluid passing through the relief valve 19, if hydraulic fluid flows to the non-cooling oil line R11 at a too high rate, the hydraulic fluid is liable to be excessively heated. In view of this problem, a restrictor 14*b* is provided in the guide passage 14*a* for restricting the flow of hydraulic fluid flowing from the cooling oil line R4 to the non-cooling oil line R11. This makes it possible to prevent the excessive heating of hydraulic fluid. Further, the restrictor 14*b* is provided at the neutral position of the arm control valve 14, which makes it possible to prevent the restrictor 14*b* from affecting the flow of hydraulic fluid as flow resistance when the arm control valve 14 is at the extension position or the contraction position.

Further, because the guide passage 14*a* is provided at the neutral position of the arm control valve 14, the shifting of the arm control valve 14 to the extension position or the contraction position automatically leads to disconnection of the cooling oil line R4 and the non-cooling oil line R11.

Therefore, hydraulic fluid discharged from the arm cylinder 9 is led to the tank 15 through the cooling oil line R4 to be cooled by the oil cooler 17 when the arm control valve 14 is shifted to the extension position (not shown).

Figure 4:
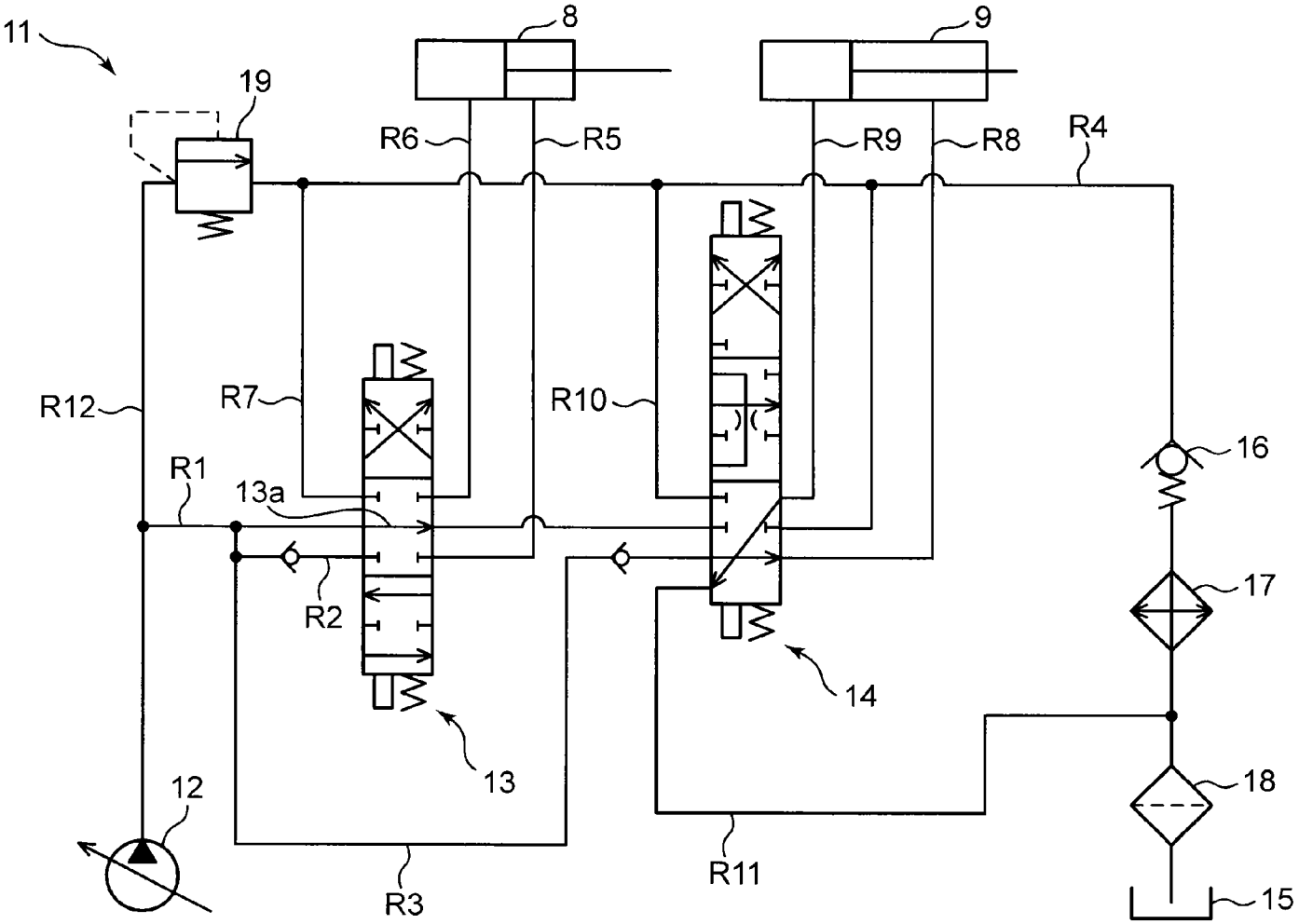
FIG. 4 is a circuit diagram illustrating an operation of the hydraulic circuit shown in FIG. 2 to move an arm forward.

On the other hand, the non-cooling oil line R11 is connected with the arm control valve 14 in such a way as to be connected to the bottom-side oil line R9 of the arm cylinder 9 when the arm control valve 14 is shifted to the contraction position, as shown in FIG. 4. This makes it possible to reduce the pressure loss of return oil discharged from the arm cylinder 9 in the forward movement of the arm 6.

Specifically, because a cross-sectional area of the bottom-side chamber is greater than that of the rod-side chamber, the flow rate of hydraulic fluid discharged from the bottom-side chamber is higher than the flow rate of hydraulic fluid supplied to the rod-side chamber in the contraction of the arm cylinder 9. Therefore, if hydraulic fluid discharged from the bottom-side chamber is led to the cooling oil line R4 in the contraction of the arm cylinder 9, a large amount of hydraulic fluid would flow through the back pressure valve 16 and the oil cooler 17, and consequently involve a great pressure loss. The pressure loss is considered to be great, especially when the arm 6 is moved forward by its own weight.

In view of this problem, hydraulic fluid discharged from the bottom-side chamber in the moving forward of the arm 6 is caused to flow to the tank 15 without passing though the oil cooler 17 (i.e. led to the non-cooling oil line R11). This makes it possible to prevent hydraulic fluid from flowing through the back pressure valve 16 and the oil cooler 17 at a high rate, which can reduce the pressure loss of the hydraulic fluid.

As described above, the shifting of the arm control valve 14 to the extension position (permitting position) allows hydraulic fluid discharged from the arm cylinder 9 to flow to the tank 15 through the oil cooler 17 where the hydraulic fluid is cooled.

On the other hand, the shifting of the arm control valve 14 to the neutral position (restricting position) allows hydraulic fluid discharged from the hydraulic pump 12 to flow to the tank 15 though the guide passage 14*a* and the non-cooling oil line 11 without passing through the oil cooler 17. Therefore, the hydraulic fluid is allowed to circulate in the hydraulic circuit 11 without being cooled. This makes it possible to heat the hydraulic fluid by heat generated with occurrences of pressure losses or the like in the flow passage, to thereby warm up the hydraulic excavator 1.

Further, because the guide passage 14*a* is provided in the arm control valve 14, there is no need to provide a switch valve in addition to the control valve as in the prior art. This makes it possible to simplify the configuration of, and reduce cost for, the hydraulic excavator 1.

Therefore, it is possible to warm up the hydraulic excavator 1 without including an additional hydraulic device.

According to the first embodiment, the following advantageous effects can be provided.

It is possible to allow hydraulic fluid to flow to the cooling oil line R4 through the center bypass passage 14*c* and then to the non-cooling oil line R11 through the guide passage 14*a*. Therefore, hydraulic fluid is allowed to flow through a longer passage than in the case where the discharge oil line (tandem oil line R1) of the hydraulic pump 12 is directly connected to the non-cooling oil line R11. This makes it possible to increase the amount of heat of hydraulic fluid generated with occurrences of pressure losses in the flow passage.

Further, the cooling oil line R4 may usually be shut off from the arm control valve 14 when the arm control valve 14 is at the neutral position (restricting position). However, in the first embodiment, the simple modification is made to provide the guide passage 14*a* at the neutral position of the arm control valve 14 to make it possible to use a part of the cooling oil line R4 as a flow passage of hydraulic fluid to warm up the hydraulic excavator 1. Therefore, it is possible to warm up the hydraulic excavator 1 efficiently while making use of the existing configuration.

Hydraulic fluid heated by the opening of the relief valve 19 is led to the cooling oil line R4 and then to the non-cooling oil line R11 through the guide passage 14*a*. Therefore, it is possible, for example, to operate the boom cylinder 8 so as to intentionally open the relief valve 19 (for example, to perform an operation to supply hydraulic fluid to the boom cylinder 8 when the rod is already at its stroke end position) to use heat to be generated due to the opening of the relief valve 19 to warm up the hydraulic excavator 1, to thereby shorten the warming up time.

It is possible to restrict the flow of hydraulic fluid to be led to the non-cooling oil line R11 by means of the restrictor 14*b*, to thereby relatively increase the flow of hydraulic fluid to be led to the cooling oil line R4. This makes it possible to prevent excessive heating of hydraulic fluid.

It is possible to use the non-cooling oil line R11 also as an oil line for reducing the pressure loss of hydraulic fluid discharged from the arm cylinder 9. This allows efficient use of the space in the hydraulic excavator 1 and suppression of an increase in cost.

Figure 5:
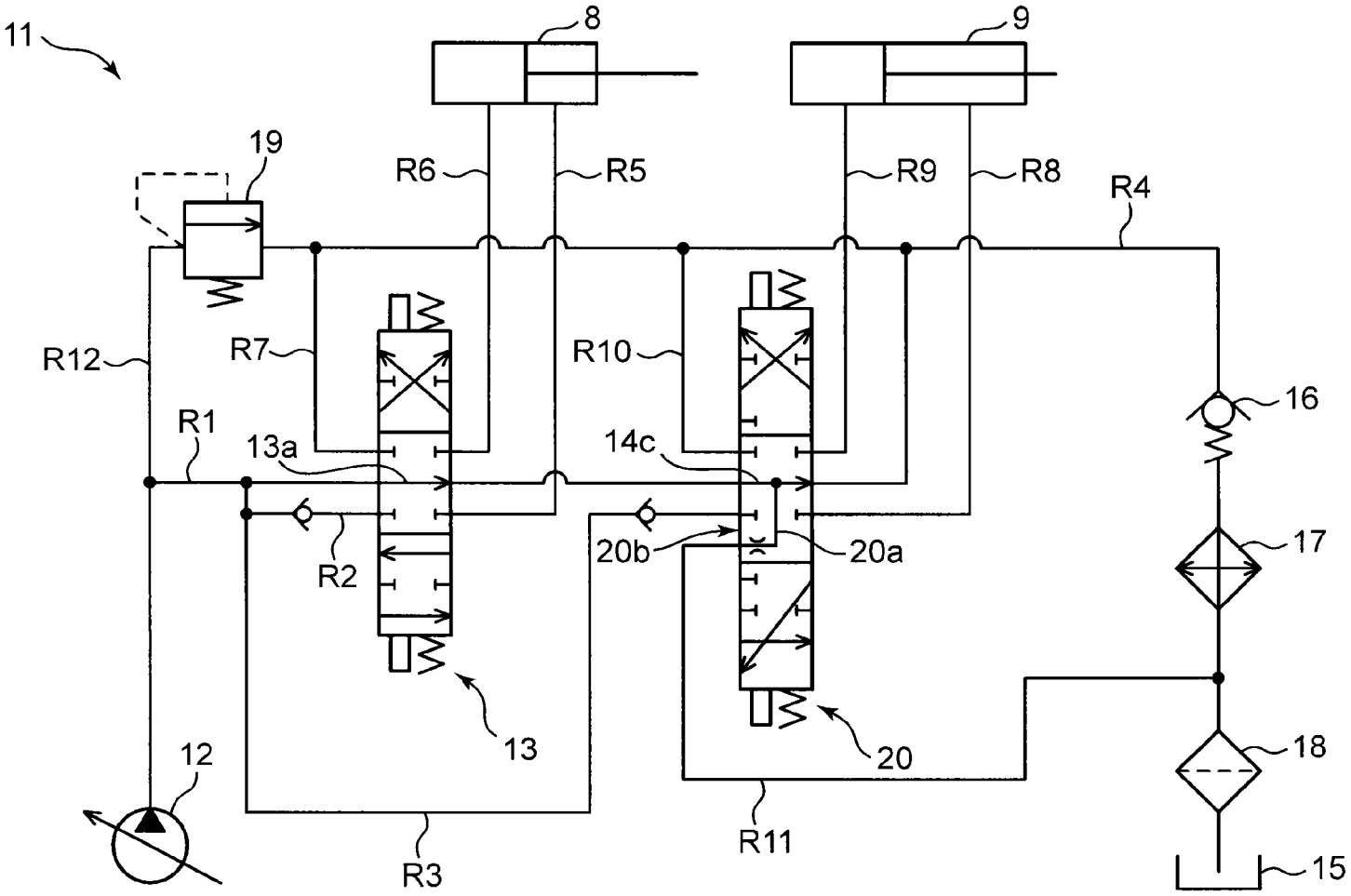
FIG. 5 is a circuit diagram showing a hydraulic circuit provided in a hydraulic excavator according to a second embodiment of the present invention.

Second Embodiment (FIG. 5)

In the first embodiment, the guide passage 14*a* has been described as connecting the cooling oil line R4 and the non-cooling oil line R11. However, it is only necessary to provide a guide passage capable of leading hydraulic fluid discharged from the hydraulic pump 12 to the non-cooling oil line R11.

FIG. 5 is a circuit diagram showing an arm control valve 20 according to a second embodiment. In FIG. 5, elements identical to those of the first embodiment are denoted by the same respective reference numerals as in the first embodiment, and the description thereof will be omitted.

A guide passage 20*a* is provided at a neutral position of the arm control valve 20 for allowing hydraulic fluid discharged from a hydraulic pump 12 to directly flow to a non-cooling oil line R11 without passing through a cooling oil line R4.

Specifically, the guide passage 20*a* connects a tandem oil line R1 (center bypass passage 14*c*) with the non-cooling oil line R11 when the arm control valve 20 is at the neutral position.

Also in the second embodiment, it is possible to allow hydraulic fluid discharged from the hydraulic pump 12 to flow to a tank 15 without passing through an oil cooler 17 when the arm control valve 20 is at the neutral position. This allows the hydraulic fluid to be heated to thereby warm up the hydraulic excavator.

If hydraulic fluid flows to the non-cooling oil line R11 at a too high rate, the hydraulic fluid is liable to be excessively heated. In view of this problem, similarly to the first embodiment, a restrictor 20*b* is provided in the guide passage 20*a* for restricting the flow of hydraulic fluid flowing from the tandem oil line R1 to the non-cooling oil line R11. This makes it possible to prevent excessive heating of hydraulic fluid.

The present invention is not limited to the above-described embodiments and, for example, the following modified embodiments may be adopted.

The construction machine has been illustrated as a hydraulic excavator. However, the present invention may be applied to other construction machines such as a demolishing machine and a crane.

In the above-described embodiment, the relief oil line R12 including the relief valve 19 is connected with the cooling oil line R4. However, the relief valve 19 and the relief oil line R12 may be omitted.

The regulator is not limited to the restrictor 14*b*. The guide passage 14*a* may be modified to have a smaller overall cross-sectional area so that the flow resistance of hydraulic fluid in the guide passage 14*a* becomes greater. Further, the regulator may be omitted.

In the above-described embodiment, the non-cooling oil line R11 also serves as an oil line for preventing a pressure loss of hydraulic fluid in the contraction of the arm cylinder 9. However, a modification may be made to provide a non-cooling oil line dedicated to warming up a machine.

The hydraulic actuator is not limited to the arm cylinder 9, and the another hydraulic actuator is not limited to the boom cylinder 8. The hydraulic actuator and the another hydraulic actuator may be provided as a hydraulic cylinder for driving a component other than the boom 5 and the arm 6 (such as the bucket 7), or as a type of actuator other than the hydraulic cylinder (such as a hydraulic motor).

The above-described specific embodiments mainly include the invention configured as follows.

The present invention provides a construction machine, comprising: a hydraulic pump for discharging hydraulic fluid; a hydraulic actuator to be operated by hydraulic fluid discharged from the hydraulic pump; a tank for receiving hydraulic fluid discharged from the hydraulic actuator; a control valve shiftable between a permitting position to permit supply of hydraulic fluid from the hydraulic pump to the hydraulic actuator and discharge of hydraulic fluid from the hydraulic actuator to the tank and a restricting position to restrict the supply and the discharge of hydraulic fluid; a cooling oil line including an oil cooler for cooling hydraulic fluid, and being connected to the control valve for leading hydraulic oil discharged from the control valve to the tank through the oil cooler when the control valve is shifted to the permitting position; and a non-cooling oil line connected to the control valve for leading hydraulic oil discharged from the control valve to the tank running away from the oil cooler when the control valve is shifted to the restricting position, wherein the control valve includes a guide passage provided at the restricting position for allowing hydraulic oil discharged from the hydraulic pump to flow to the non-cooling oil line.

According to the present invention, the shifting of the control valve to the permitting position allows hydraulic fluid discharged from the hydraulic actuator to flow to the tank through the oil cooler where the hydraulic fluid is cooled.

On the other hand, the shifting of the control valve to the restricting position allows hydraulic fluid discharged from the hydraulic pump to flow to the tank through the guide passage and non-cooling oil line without passing through the oil cooler. Therefore, the hydraulic fluid is allowed to circulate in the hydraulic circuit without being cooled. This makes it possible to heat the hydraulic fluid by heat generated with occurrences of pressure losses or the like in the flow passage, to thereby warm up the construction machine.

Further, because the guide passage is provided in the control valve, there is no need to provide a shift valve independently of the control valve as in the prior art. This makes it possible to simplify the configuration of, and reduce cost for, the construction machine.

Therefore, according to the present invention, it is possible to warm up the construction machine without including an additional hydraulic device.

Here, the guide passage may be so configured as to lead hydraulic fluid discharged from the hydraulic pump directly to the non-cooling oil line. However, in this case, the hydraulic fluid would flow through a short passage (the discharge line of the hydraulic pump, the guide passage, and the non-cooling oil line), which would result in a small amount in the heat generated with occurrences of pressure losses in the flow passage.

Accordingly, in the above-described construction machine, it is preferred that the control valve includes a bypass passage provided at the restricting position, the hydraulic pump being connected to the cooling oil line upstream of the oil cooler through the bypass passage, and the guide passage connects the cooling oil line and the non-cooling oil line when the control valve is shifted to the restricting position.

The flow resistance of hydraulic fluid in the cooling oil line is greater than that in the non-cooling oil line due to the presence of the oil cooler. This allows hydraulic fluid, when the cooling oil line and the non-cooling oil line are connected, to be more likely to flow to the non-cooling oil line running away from the oil cooler.

Therefore, according to this configuration, it is possible to allow hydraulic fluid to flow to the cooling oil line through the bypass passage and subsequently from the cooling oil line to the non-cooling oil line through the guide passage. This allows the hydraulic fluid to flow through a longer passage than in the case where the discharge oil line of the hydraulic pump is directly connected to the non-cooling oil line. This makes it possible to increase the amount of heat generated with occurrences of pressure losses in the flow passage.

Further, the cooling oil line may usually be shut off from the control valve when the control valve is at the restricting position. However, in the above-described configuration, the simple modification is made to provide the guide passage at the restricting position of the control valve to make it possible to use a part of the cooling oil line as a flow passage of hydraulic oil to warm up the construction machine. This makes it possible to warm up the construction machine efficiently while making use of the existing configuration.

Here, the construction machine may be warmed up only by hydraulic fluid flowing from the hydraulic pump to the cooling oil line through the bypass passage of the control valve. However, in this case, pressure losses in the flow passage would be a main heat source. Thus, it would be difficult to shorten the warming up time.

Accordingly, the above-described construction machine preferably further comprises: another hydraulic actuator to be operated by hydraulic fluid discharged from the hydraulic pump; and a relief valve connected to the hydraulic pump, and being opened when a discharge pressure of the hydraulic pump for the another hydraulic actuator exceeds a predetermined relief pressure. Further, it is preferred that the cooling line is connected with the relief valve in such a way as to receive hydraulic fluid discharged from the relief valve when the relief valve is opened.

According to this configuration, hydraulic fluid heated when the relief valve is opened is led to the cooling oil line and then to the non-cooling oil line through the guide passage. Therefore, it is possible, for example, to operate the another hydraulic actuator so as to intentionally open the relief valve (for example, by performing an operation to supply hydraulic fluid to a hydraulic cylinder when a rod is already at its stroke end position) to use heat to be generated when the relief valve is opened to warm up the construction machine, to thereby shorten the warming up time.

Here, the guide passage may allow hydraulic fluid to flow to the non-cooling oil line at a flow rate that depends only on the difference between the flow resistance in the cooling oil line and the flow resistance in the non-cooling oil line. In this case, however, the hydraulic fluid would be liable to flow to the non-cooling oil line at an excessively high rate, which would result in excessive heating of the hydraulic fluid.

Accordingly, in the above-described construction machine, it is preferred that the guide passage includes a regulator for restricting the flow of hydraulic fluid from the cooling oil line to the non-cooling oil line.

This configuration makes it possible to restrict the flow of hydraulic fluid to be led to the non-cooling oil line by the regulator to thereby relatively increase the flow rate of hydraulic fluid flowing to the cooling oil line. This makes it possible to prevent excessive heating of hydraulic fluid.

Here, the non-cooling oil line may be used only to warm up the construction machine. However, in this case, the inclusion of the hydraulic line dedicated to warming up the construction machine would lead to reduction of space in the machine and an increase in the cost.

Accordingly, in the above-described construction machine, it is preferred that the hydraulic actuator includes a hydraulic cylinder to be extended and contracted by hydraulic fluid discharged from the hydraulic pump, and the control valve is shifted between the restricting position, the permitting position to permit the extension of the hydraulic cylinder, and a contraction position to permit the contraction of the hydraulic cylinder, the control valve being connected to the non-cooling oil line for leading hydraulic fluid discharged from the hydraulic cylinder to the non-cooling oil line when the control valve is shifted to the contraction position.

According to this configuration, the non-cooling oil line is allowed to also serve as an oil line for reducing the pressure loss of hydraulic fluid discharged from the hydraulic cylinder. This makes it possible to efficiently use the space in the construction machine and suppress an increase in cost.

Specifically, in the contraction of the hydraulic cylinder, the flow rate of hydraulic fluid discharged from a bottom-side chamber of the hydraulic cylinder is higher than the flow rate of hydraulic fluid supplied to a rod-side chamber of the hydraulic cylinder due to the difference in the cross-sectional area between the rod-side chamber and the bottom-side chamber. Therefore, if hydraulic fluid discharged from the bottom-side chamber is led to the cooling oil line in the contraction of the hydraulic cylinder, a large amount of hydraulic fluid would flow through the oil cooler, which would result in a great pressure loss of the hydraulic fluid. In particular, the pressure loss would be great, especially when a driven object (for example, an arm) to be driven by the hydraulic cylinder is moved by its own weight (for example, in the case of moving the arm forward).

In contrast, the above-described configuration is provided to allow hydraulic fluid discharged from the bottom-side chamber to flow to the tank without passing though the oil cooler (i.e. to be led to the non-cooling oil line). This makes it possible to prevent hydraulic fluid from flowing through the oil cooler at a high rate, which can reduce the pressure loss of the hydraulic fluid.

Therefore, according to the above-described configuration, the non-cooling oil line is used to warm up the construction machine when the hydraulic cylinder is stopped, and to reduce the pressure loss of hydraulic fluid when the hydraulic cylinder is contracted.

This application is based on Japanese Patent application No. 2014-118301 filed in Japan Patent Office on Jun. 9, 2014, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A construction machine, comprising:

a hydraulic pump for discharging hydraulic fluid;

a hydraulic actuator to be operated by hydraulic fluid discharged from the hydraulic pump;

a tank for receiving hydraulic fluid discharged from the hydraulic actuator;

a control valve shiftable between a permitting position to permit supply of hydraulic fluid from the hydraulic pump to the hydraulic actuator and discharge of hydraulic fluid from the hydraulic actuator to the tank and a restricting position to restrict the supply and the discharge of hydraulic fluid;

a cooling oil line including an oil cooler for cooling hydraulic fluid, and being connected to the control valve for leading hydraulic oil discharged from the control valve to the tank through the oil cooler when the control valve is shifted to the permitting position; and a non-cooling oil line connected to the control valve for leading hydraulic oil discharged from the control valve to the tank running away from the oil cooler when the control valve is shifted to the restricting position, wherein the control valve includes a guide passage provided at the restricting position for allowing hydraulic oil discharged from the hydraulic pump to flow to the non-cooling oil line.

2. A construction machine according to claim 1, wherein the control valve includes a bypass passage provided at the restricting position, the hydraulic pump being connected to the cooling oil line upstream of the oil cooler through the bypass passage, and the guide passage connects the cooling oil line and the non-cooling oil line when the control valve is shifted to the restricting position.

3. A construction machine according to claim 2, further comprising:

another hydraulic actuator to be operated by hydraulic fluid discharged from the hydraulic pump; and a relief valve connected to the hydraulic pump, and being opened when a discharge pressure of the hydraulic pump for the another hydraulic actuator exceeds a predetermined relief pressure, wherein the cooling line is connected with the relief valve in such a way as to receive hydraulic fluid discharged from the relief valve when the relief valve is opened.

4. A construction machine according to claim 2, wherein the guide passage includes a regulator for restricting the flow of hydraulic fluid from the cooling oil line to the non-cooling oil line.

5. A construction machine according to claim 1, wherein the hydraulic actuator includes a hydraulic cylinder to be extended and contracted by hydraulic fluid discharged from the hydraulic pump, and the control valve is shifted between the restricting position, the permitting position to permit the extension of the hydraulic cylinder, and a contraction position to permit the contraction of the hydraulic cylinder, the control valve being connected to the non-cooling oil line for leading hydraulic fluid discharged from the hydraulic cylinder to the non-cooling oil line when the control valve is shifted to the contraction position.

* * * * *